US010392910B2

(12) United States Patent
Walton et al.

(10) Patent No.: US 10,392,910 B2
(45) Date of Patent: Aug. 27, 2019

(54) MULTI-ZONE ACTUATION SYSTEM USING WELLBORE DARTS

(71) Applicant: Halliburton Energy Services, Inc., Houston, TX (US)

(72) Inventors: Zachary Walton, Carrollton, TX (US); Matthew Merron, Carrollton, TX (US); Matthew Todd Howell, Duncan, OK (US); Vijay Kumar Keerthivasan, Singapore (SG); Ryan Zhe Cong Foong, Selangor (MY)

(73) Assignee: Halliburton Energy Services, Inc., Houston, TX (US)

( * ) Notice: Subject to any disclaimer, the term of this patent is extended or adjusted under 35 U.S.C. 154(b) by 238 days.

(21) Appl. No.: 14/654,597

(22) PCT Filed: Aug. 1, 2014

(86) PCT No.: PCT/US2014/049423
§ 371 (c)(1),
(2) Date: Jun. 22, 2015

(87) PCT Pub. No.: WO2016/018429
PCT Pub. Date: Feb. 4, 2016

(65) Prior Publication Data

US 2016/0258260 A1 Sep. 8, 2016

(51) Int. Cl.
*E21B 43/12* (2006.01)
*E21B 34/14* (2006.01)
(Continued)

(52) U.S. Cl.
CPC ..... *E21B 43/12* (2013.01); *E21B 33/13* (2013.01); *E21B 34/06* (2013.01); *E21B 34/066* (2013.01);
(Continued)

(58) Field of Classification Search
CPC .... E21B 34/14; E21B 34/06; E21B 2034/007; E21B 33/12; E21B 43/14; E21B 43/26;
(Continued)

(56) References Cited

U.S. PATENT DOCUMENTS 8,403,068 B2 * 3/2013 Robison ..... E21B 23/006 166/194
2006/0081380 A1 * 4/2006 Hoffman ..... E21B 23/06 166/381
(Continued)

FOREIGN PATENT DOCUMENTS

WO 2016018429 A1 2/2016

OTHER PUBLICATIONS

International Search Report and Written Opinion for PCT/US2014/049423 dated May 1, 2015.
(Continued)

*Primary Examiner* — George S Gray
(74) *Attorney, Agent, or Firm* — McGuireWoods LLP

(57) ABSTRACT

Sliding sleeve assemblies including a completion body with an inner flow passageway and one or more ports enabling fluid communication between the inner flow passageway and an exterior of the completion body. A sliding sleeve is arranged within the completion body and has a sleeve mating profile defined on an inner surface, the sliding sleeve being movable between a closed position, where the one or more ports are occluded, and an open position, where the one or more ports are exposed. A plurality of wellbore darts are used and each has a body and a common dart profile that is matable with the sleeve mating profile. One or more sensors are positioned on the completion body to detect the plurality of wellbore darts traversing the inner flow passageway. An actuation sleeve is arranged within the completion body and movable to expose the sleeve mating profile.

20 Claims, 5 Drawing Sheets

(51) Int. Cl.

| | |
|---|---|
| ***E21B 34/06*** | (2006.01) |
| ***E21B 33/13*** | (2006.01) |
| ***E21B 34/10*** | (2006.01) |
| ***E21B 47/09*** | (2012.01) |
| ***E21B 47/12*** | (2012.01) |
| *E21B 34/00* | (2006.01) |
| *E21B 43/26* | (2006.01) |

(52) U.S. Cl.
CPC ..... *E21B 34/103* (2013.01); *E21B 34/14* (2013.01); *E21B 47/0905* (2013.01); *E21B 47/122* (2013.01); *E21B 43/26* (2013.01); *E21B 2034/007* (2013.01)

(58) Field of Classification Search
CPC ..... E21B 34/066; E21B 34/13; E21B 33/13; E21B 43/12
See application file for complete search history.

(56) References Cited

U.S. PATENT DOCUMENTS

| | | | | |
|---|---|---|---|---|
| 2011/0056692 | A1 | 3/2011 | Lopez de Cardenas et al. | |
| 2011/0198096 | A1 | 8/2011 | Mailand et al. | |
| 2013/0062063 | A1 | 3/2013 | Baihly et al. | |
| 2013/0112436 | A1* | 5/2013 | Fleming | E21B 23/006 166/386 |
| 2013/0118732 | A1* | 5/2013 | Chauffe | E21B 34/06 166/250.04 |
| 2013/0206402 | A1* | 8/2013 | Coon | E21B 23/08 166/255.1 |
| 2013/0220603 | A1* | 8/2013 | Robison | E21B 23/006 166/250.04 |
| 2015/0300097 | A1* | 10/2015 | O'Connor | E21B 41/00 166/381 |
| 2016/0251937 | A1* | 9/2016 | Fripp | E21B 43/12 |

OTHER PUBLICATIONS

Considered Approach Improve Hydraulic Fracturing in Horizontal Open Holes, Published in E&P Magazine, Jul. 1, 2009.

Baker Hughes On-Line Brochure, OptiPort and OptiFrac CT-Activated Multistage Fracturing Systems, <http://www.bakerhughes.com/products-and-services/completions/well-completions/multistage-hydraulic-fracturing/optiport-multistage-fracturing-system>, not dated.

Weatherford On-Line Brochure, ZoneSelect® I-Ball® Multizone Stimulation Sleeves, <http://apps.weatherford.com/results/pdf/WFT214186.pdf>, not dated.

Drilling Contractor, Completing the Shale Puzzle, http://www.drillingcontractor.org/completing-the-shale-puzzle-20441, not dated.

* cited by examiner

MULTI-ZONE ACTUATION SYSTEM USING WELLBORE DARTS

BACKGROUND

The present disclosure relates generally to wellbore operations and, more particularly, to a multi-zone actuation system that detects wellbore darts in carrying out multiple-interval stimulation of a wellbore.

In the oil and gas industry, subterranean formations penetrated by a wellbore are often fractured or otherwise stimulated in order to enhance hydrocarbon production. Fracturing and stimulation operations are typically carried out by strategically isolating various zones of interest (or intervals within a zone of interest) in the wellbore using packers and the like, and then subjecting the isolated zones to a variety of treatment fluids at increased pressures. In a typical fracturing operation for a cased wellbore, the casing cemented within the wellbore is first perforated to allow conduits for hydrocarbons within the surrounding subterranean formation to flow into the wellbore. Prior to producing the hydrocarbons, however, treatment fluids are pumped into the wellbore and the surrounding formation via the perforations, which has the effect of opening and/or enlarging drainage channels in the formation, and thereby enhancing the producing capabilities of the well.

Today, it is possible to stimulate multiple zones during a single stimulation operation by using onsite stimulation fluid pumping equipment. In such applications, several packers are introduced into the wellbore and each packer is strategically located at predetermined intervals configured to isolate adjacent zones of interest. Each zone may include a sliding sleeve that is moved to permit zonal stimulation by diverting flow through one or more tubing ports occluded by the sliding sleeve. Once the packers are appropriately deployed, the sliding sleeves may be selectively shifted open using a ball and baffle system. The ball and baffle system involves sequentially dropping wellbore projectiles from a surface location into the wellbore. The wellbore projectiles, commonly referred to as "frac balls," are of predetermined sizes configured to seal against correspondingly sized baffles or seats disposed within the wellbore at corresponding zones of interest. The smaller frac balls are introduced into the wellbore prior to the larger frac balls, where the smallest frac ball is designed to land on the baffle furthest in the well, and the largest frac ball is designed to land on the baffle closest to the surface of the well. Accordingly, the frac balls isolate the target sliding sleeves, from the bottom-most sleeve moving uphole. Applying hydraulic pressure from the surface serves to shift the target sliding sleeve to its open position.

Thus, the ball and baffle system acts as an actuation mechanism for shifting the sliding sleeves to their open position downhole. When the fracturing operation is complete, the balls can be either hydraulically returned to the surface or drilled up along with the baffles in order to return the casing string to a full bore inner diameter. As can be appreciated, at least one shortcoming of the ball and baffle system is that there is a limit to the maximum number of zones that may be fractured owing to the fact that the baffles are of graduated sizes.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to wellbore operations and, more particularly, to a multi-zone actuation system that detects wellbore darts in carrying out multiple-interval stimulation of a wellbore.

The embodiments described herein disclose sliding sleeve assemblies that are able to detect wellbore darts and actuate a sliding sleeve upon detecting a predetermined number of wellbore darts having dart profiles defined thereon. Once a predetermined number of wellbore darts has been detected, an actuation sleeve may be actuated to expose a sleeve mating profile defined on a sliding sleeve. After the sleeve mating profile is exposed, a subsequent wellbore dart introduced downhole may be able to locate and mate with its dart profile with the sleeve mating profile. Upon applying fluid pressure uphole from the subsequent wellbore dart, the sliding sleeve may then be moved to an open position, where flow ports become exposed and facilitate fluid communication into a surrounding subterranean environment for wellbore stimulation operations. The presently disclosed embodiments, therefore, provide intervention-less wellbore stimulation methods and systems.

Figure 1:
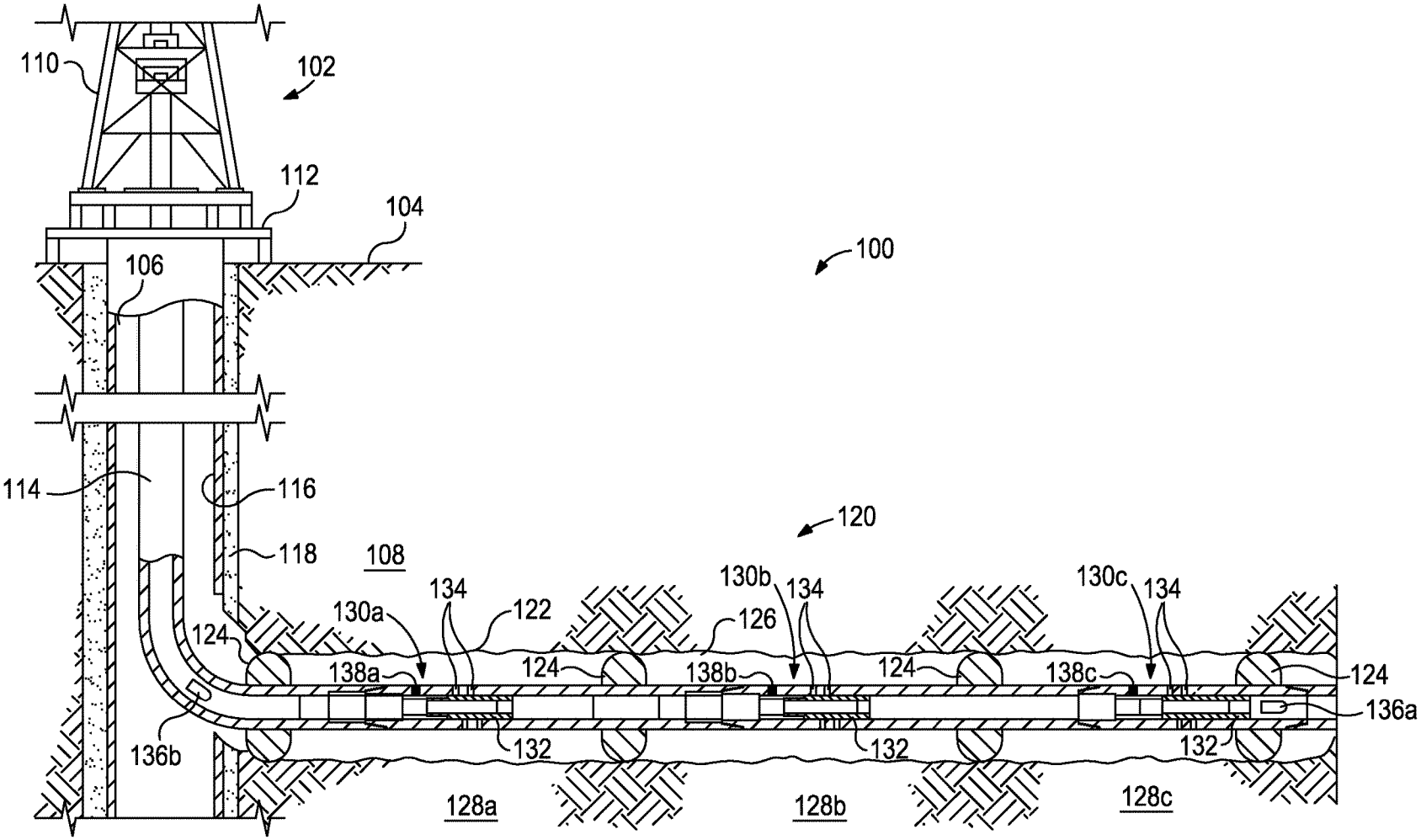
FIG. 1 illustrates an exemplary well system that can embody or otherwise employ one or more principles of the present disclosure, according to one or more embodiments.

Referring to FIG. 1, illustrated is an exemplary well system 100 which can embody or otherwise employ one or more principles of the present disclosure, according to one or more embodiments. As illustrated, the well system 100 may include an oil and gas rig 102 arranged at the Earth's surface 104 and a wellbore 106 extending therefrom and penetrating a subterranean earth formation 108. Even though FIG. 1 depicts a land-based oil and gas rig 102, it will be appreciated that the embodiments of the present disclosure are equally well suited for use in other types of rigs, such as offshore platforms, or rigs used in any other geographical location. In other embodiments, the rig 102 may be replaced with a wellhead installation, without departing from the scope of the disclosure.

The rig 102 may include a derrick 110 and a rig floor 112. The derrick 110 may support or otherwise help manipulate the axial position of a work string 114 extended within the wellbore 106 from the rig floor 112. As used herein, the term "work string" refers to one or more types of connected lengths of tubulars or pipe such as drill pipe, drill string, landing string, production tubing, coiled tubing combinations thereof, or the like. The work string 114 may be utilized in drilling, stimulating, completing, or otherwise servicing the wellbore 106, or various combinations thereof.

As illustrated, the wellbore 106 may extend vertically away from the surface 104 over a vertical wellbore portion. In other embodiments, the wellbore 106 may otherwise deviate at any angle from the surface 104 over a deviated or horizontal wellbore portion. In other applications, portions or substantially all of the wellbore 106 may be vertical, deviated, horizontal, and/or curved. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the heel or surface of the well and the downhole direction being toward the toe or bottom of the well.

In an embodiment, the wellbore 106 may be at least partially cased with a casing string 116 or may otherwise remain at least partially uncased. The casing string 116 may be secured within the wellbore 106 using, for example, cement 118. In other embodiments, the casing string 116 may be only partially cemented within the wellbore 106 or, alternatively, the casing string 116 may be omitted from the well system 100, without departing from the scope of the disclosure. The work string 114 may be coupled to a completion assembly 120 that extends into a branch or lateral portion 122 of the wellbore 106. As illustrated, the lateral portion 122 may be an uncased or "open hole" section of the wellbore 106. It is noted that although FIG. 1 depicts the completion assembly 120 as being arranged within the lateral portion 122 of the wellbore 106, the principles of the apparatus, systems, and methods disclosed herein may be similarly applicable to or otherwise suitable for use in wholly vertical wellbore configurations. Consequently, the horizontal or vertical nature of the wellbore 106 should not be construed as limiting the present disclosure to any particular wellbore 106 configuration.

The completion assembly 120 may be deployed within the lateral portion 122 of the wellbore 106 using one or more packers 124 or other wellbore isolation devices known to those skilled in the art. The packers 124 may be configured to seal off an annulus 126 defined between the completion assembly 120 and the inner wall of the wellbore 106. As a result, the subterranean formation 108 may be effectively divided into multiple intervals or "pay zones" 128 (shown as intervals 128*a*, 128*b*, and 128*c*) which may be stimulated and/or produced independently via isolated portions of the annulus 126 defined between adjacent pairs of packers 124. While only three intervals 128*a-c* are shown in FIG. 1, those skilled in the art will readily recognize that any number of intervals 128*a-c* may be defined or otherwise used in the well system 100, including a single interval, without departing from the scope of the disclosure.

The completion assembly 120 may include one or more sliding sleeve assemblies 130 (shown as sliding sleeve assemblies 130*a*, 130*b*, and 130*c*) arranged in, coupled to, or otherwise forming integral parts of the work string 114. As illustrated, at least one sliding sleeve assembly 130*a-c* may be arranged in each interval 128*a-c*, but those skilled in the art will readily appreciate that more than one sliding sleeve assembly 130*a-c* may be arranged in each interval 128*a-c*, without departing from the scope of the disclosure. It should be noted that, while the sliding sleeve assemblies 130*a-c* are shown in FIG. 1 as being employed in an open hole section of the wellbore 106, the principles of the present disclosure are equally applicable to completed or cased sections of the wellbore 106. In such embodiments, a cased wellbore 106 may be perforated at predetermined locations in each interval 128*a-c* to facilitate fluid conductivity between the interior of the work string 114 and the surrounding intervals 128*a-c* of the formation 108.

Each sliding sleeve assembly 130*a-c* may be actuated in order to provide fluid communication between the interior of the work string 114 and the annulus 126 adjacent each corresponding interval 128*a-c*. As depicted, each sliding sleeve assembly 130*a-c* may include a sliding sleeve 132 that is axially movable within the work string 114 to expose one or more ports 134 defined through the work string 114. Once exposed, the ports 134 may facilitate fluid communication between the annulus 126 and the interior of the work string 114 such that stimulation and/or production operations may be undertaken in each corresponding interval 128*a-c* of the formation 108.

According to the present disclosure, in order to move the sliding sleeve 132 of a given sliding sleeve assembly 130*a-c* to its open position, and thereby expose the corresponding ports 134, one or more wellbore darts 136 (shown as a first wellbore dart 136*a* and a second wellbore dart 136*b*) may be introduced into the work string 114 and conveyed downhole toward the sliding sleeve assemblies 130*a-c*. The wellbore darts 136 may be conveyed through the work string 114 and to the completion assembly 120 by any known technique. For example, the wellbore darts 136 can be dropped through the work string 114 from the surface 104, pumped by flowing fluid through the interior of the work string 114, self-propelled, conveyed by wireline, slickline, coiled tubing, etc.

Each wellbore dart 136 may be detectable by one or more sensors 138 (shown as sensors 138*a*, 138*b*, and 138*c*) associated with each sliding sleeve assembly 130*a-c*. In some embodiments, for instance, the wellbore darts 136 may exhibit known magnetic properties, and/or produce a known magnetic field, pattern, or combination of magnetic fields, which is/are detectable by the sensors 138*a-c*. In such cases, each sensor 138*a-c* may be capable of detecting the presence of the magnetic field(s) produced by the wellbore darts 136 and/or one or more other magnetic properties of the wellbore darts 136. Suitable magnetic sensors 138*a-c* can include, but are not limited to, magneto-resistive sensors, Hall-effect sensors, conductive coils, combinations thereof, and the like. In some embodiments, permanent magnets can be combined with one or more of the sensors 138*a-c* in order to create a magnetic field that is disturbed by the wellbore darts 136, and a detected change in the magnetic field can be an indication of the presence of the wellbore darts 136.

Moreover, in some embodiments, each sensor 138*a-c* may include a barrier (not shown) positioned between the sensor 138*a-c* and the wellbore darts 136. The barrier may comprise a relatively low magnetic permeability material and may be configured to allow magnetic signals to pass therethrough and isolate pressure between the sensor 138*a-c* and the wellbore darts 136. Additional information on such a barrier as used in magnetic detection can be found in U.S. Patent Pub. No. 2013/0264051. In other embodiments, a magnetic shield (not shown) may be positioned either on the wellbore darts 136 or near the sensors 138*a-c* to "short circuit" magnetic fields emitted by the wellbore darts 136 and thereby reduce the amount of remnant magnetic fields that may be detectable by the sensors 138*a-c*. In such embodiments, the magnetic field may be pulled toward materials that have a high magnetic permeability, which effectively shields the sensors 138*a-c* from the remnant magnetic fields.

In other embodiments, one or more of the sensors 138*a-c* may be capable of detecting radio frequencies emitted by the wellbore darts 136. In such embodiments, the sensors 138*a-c* may be radio frequency (RF) sensors or readers capable of detecting a radio frequency identification (RFID) tag secured to or otherwise forming part of the wellbore darts 136. The RF sensors 138*a-c* may be configured to sense the RFID tags as the wellbore darts 136 traverse the work string 114 and encounter the RF sensors 138*a-c*. In at least one embodiment, the RF sensors 138*a-c* may be micro-electromechanical systems (MEMS) or devices capable of sensing radio frequencies. In such cases, the MEMS sensors may include or otherwise encompass an RF coil and thereby be used as the sensors 138*a-c*. The RF sensor 138*a-c* may alternatively be a near field communication (NFC) sensor capable of establishing radio communication with a corresponding dummy tag arranged on the wellbore darts 136. When the dummy tags come into proximity of the RF sensors 138*a-c*, the RF sensors 138*a-c* may register the presence of the wellbore darts 136.

In yet other embodiments, the sensors 138*a-c* may be a type of mechanical switch or the like that may be mechanically manipulated through physical contact with the wellbore darts 136 as they traverse the work string 114. In some cases, for instance, the mechanical sensors 138*a-c* may be ratcheting or mechanical counting devices or switches disposed near each sleeve 132. Upon physically contacting and otherwise interacting with the wellbore darts 136, the mechanical sensors 138*a-c* may be configured to generate and send corresponding signals indicative of the same to an adjacent actuation device (not shown in FIG. 1), as will be described below. In some embodiments, the mechanical sensors 138*a-c* may be spring loaded or otherwise configured such that after the wellbore dart 136 has passed (or following a certain time period thereafter) the switch may autonomously reset itself. As will be appreciated, such a resettable embodiment may allow the mechanical sensors 138*a-c* to physically interact with multiple wellbore darts 136.

Each sensor 138*a-c* may be connected to associated electronic circuitry (not shown in FIG. 1) configured to determine whether the associated sensor 138*a-c* has positively detected a wellbore dart 136. For instance, in the case where the sensors 138*a-c* are magnetic sensors, the sensors 138*a-c* may detect a particular or predetermined magnetic field, or pattern or combination of magnetic fields, or other magnetic properties of the wellbore darts 136, and the associated electronic circuitry may have the predetermined magnetic field(s) or other magnetic properties programmed into non-volatile memory for comparison. Similarly, in the case where the sensors 138*a-c* are RF sensors, the sensors 138*a-c* may detect a particular RF signal from the wellbore darts 136, and the associated electronic circuitry may either count the RF signals or compare the RF signals with RF signals programmed into its non-volatile memory.

Once a wellbore dart 136 is positively detected by the sensors 138*a-c*, the associated electronic circuitry may acknowledge and count the detection instance and, if appropriate, trigger actuation of the corresponding sliding sleeve assembly 130*a-c* using one or more associated actuation devices (not shown in FIG. 1). In some embodiments, for example, actuation of the associated sliding sleeve assembly 130*a-c* may not be triggered until a predetermined number or combination of wellbore darts 136 has been detected by the given sensors 138*a-c*. Accordingly, each sensor 138*a-c* records and counts the passing of each wellbore dart 136 and, once a predetermined number of wellbore darts 136 is detected by a given sensor 138*a-c*, the corresponding sliding sleeve assembly 130*a-c* may then be actuated in response thereto.

The completion assembly 120 may include as many sliding sleeve assemblies 130*a-c* as required to undertake a desired fracturing or stimulation operation in the subterranean formation 108. The electronic circuitry of each sliding sleeve assembly 130*a-c* may be programmed with a predetermined wellbore dart 136 "count." Upon reaching or otherwise registering the predetermined wellbore dart 136 count, each sliding sleeve assembly 130*a-c* may then be actuated. More particularly, the electronic circuitry associated with the third sliding sleeve assembly 130*c* may require the detection and counting of one wellbore dart 136 before actuating the third sliding sleeve assembly 130*c*; the electronic circuitry associated with the second sliding sleeve assembly 130*b* may require the detection and counting of two wellbore darts 136 before actuating the second sliding sleeve assembly 130*b*; and the electronic circuitry associated with the first sliding sleeve assembly 130*a* may require the detection and counting of three wellbore darts 136 before actuating the first sliding sleeve assembly 130*a*.

In the illustrated embodiment, the first wellbore dart 136*a* has been introduced into the work string 114 and conveyed past each of the sensors 138*a-c* such that each sensor 138*a-c* is able to detect the wellbore dart 136*a* and increase its wellbore dart "count" by one. Since the electronic circuitry associated with the third sliding sleeve assembly 130*c* is pre-programmed with a predetermined "count" of one wellbore dart, upon detecting the first wellbore dart 136*a*, the sliding sleeve 132 of the third sliding sleeve assembly 130*c* may be actuated to the open position. Upon conveying the second wellbore dart 136*b* into the work string 114, the first and second sensors 138*a,b* are able to detect the second wellbore dart 136*b* and increase their respective wellbore dart "counts" to two. Since the electronic circuitry associated with the second sliding sleeve assembly 130*b* is pre-programmed with a predetermined "count" of two wellbore darts, upon detecting the second wellbore dart 136*b*, the sliding sleeve 132 of the second sliding sleeve assembly 130*b* may be actuated to the open position. Upon conveying a third wellbore dart (not shown) into the work string 114, the first sensor 138*a* is able to detect the third wellbore dart and increase its wellbore dart "count" to three. Since the electronic circuitry associated with the first sliding sleeve assembly 130*a* is pre-programmed with a predetermined "count" of three wellbore darts, upon detecting the third wellbore dart, the sliding sleeve 132 of the first sliding sleeve assembly 130*a* may be actuated to the open position.

Figure 2A:
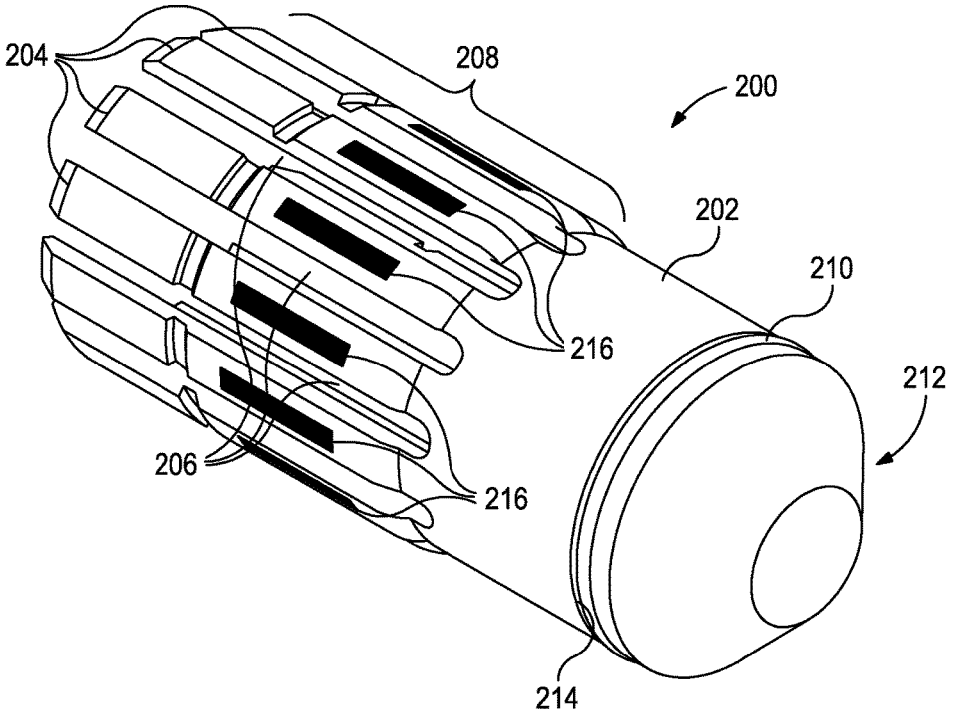
FIGS. 2A and 2B illustrate an exemplary wellbore projectile in the form of a wellbore dart, according to one or more embodiments of the present disclosure.
Figure 2B:
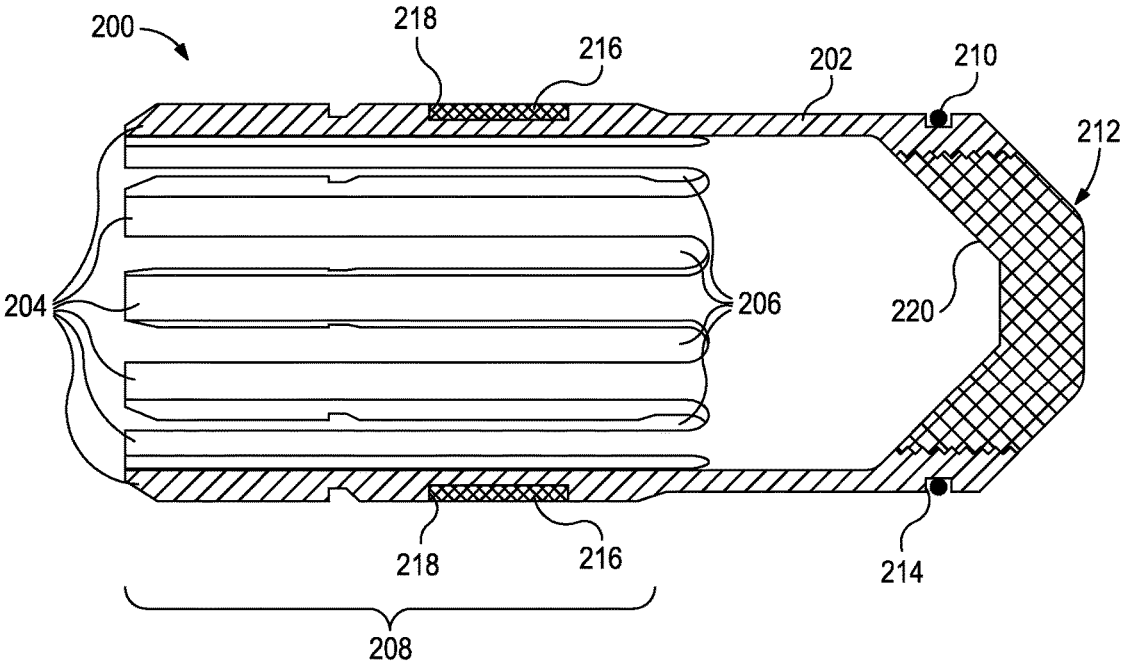

Referring now to FIGS. 2A and 2B, illustrated is an exemplary wellbore dart 200, according to one or more embodiments of the present disclosure. The wellbore dart 200 may be similar to the wellbore darts 136 of FIG. 1, and therefore may be configured to be introduced downhole to interact with the sensors 138*a-c* of the sliding sleeve assemblies 130*a-c*. FIG. 2A depicts an isometric view of the wellbore dart 200, and FIG. 2B depicts a cross-sectional side view of the wellbore dart 200. As illustrated, the wellbore dart 200 may include a generally cylindrical body 202 with a plurality of collet fingers 204 either forming part of the body 202 or extending longitudinally therefrom. The body 202 may be made of a variety of materials including, but not limited to, iron and iron alloys, steel and steel alloys, aluminum and aluminum alloys, copper and copper alloys, plastics, composite materials, and any combination thereof. In other embodiments, as described in greater detail below, all or a portion of the body 202 may be made of a degradable and/or dissolvable material, without departing from the scope of the disclosure.

In at least one embodiment, the collet fingers 204 may be flexible, axial extensions of the body 202 that are separated by elongate channels 206. A dart profile 208 may be defined on the outer radial surface of the body 202, such as on the collet fingers 204. The dart profile 208 may include or otherwise provide various features, designs, and/or configurations that enable the wellbore dart 200 to mate with a corresponding sleeve mating profile (not shown) defined on a desired sliding sleeve (e.g., the sliding sleeves 132 of FIG. 1).

The wellbore dart 200 may further include a dynamic seal 210 arranged about the exterior or outer surface of the body 202 at or near its downhole end 212. As used herein, the term "dynamic seal" is used to indicate a seal that provides pressure and/or fluid isolation between members that have relative displacement therebetween, for example, a seal that seals against a displacing surface, or a seal carried on one member and sealing against the other member. In some embodiments, the dynamic seal 210 may be arranged within a groove 214 defined on the outer surface of the body 202. The dynamic seal 210 may be made of a material selected from the following: elastomeric materials, non-elastomeric materials, metals, composites, rubbers, ceramics, derivatives thereof, and any combination thereof. In some embodiments, as depicted in FIG. 2B, the dynamic seal 210 may be an O-ring or the like. In other embodiments, however, the dynamic seal 210 may be a set of v-rings or CHEVRON® packing rings, or other appropriate seal configurations (e.g., seals that are round, v-shaped, u-shaped, square, oval, t-shaped, etc.), as generally known to those skilled in the art, or any combination thereof. As described more below, the dynamic seal 210 may be configured to "dynamically" seal against a seal bore of a sliding sleeve (not shown).

The wellbore dart 200 may further include or otherwise encompass one or more detectable sensor components 216. As used herein, the term "sensor component" refers to any mechanism, device, element, or substance that is able to interact with the sensors 138*a-c* of the sliding sleeve assemblies 130*a-c* of FIG. 1 and thereby confirm that the wellbore dart 200 has come into proximity of a given sensor 138*a-c*. For example, in some embodiments, the sensor components 216 may be magnets configured to interact with magnetic sensors 138*a-c*, as described above. In other embodiments, however, the sensor components 216 may be RFID tags (active or passive) that may be read or otherwise detected by a corresponding RFID reader associated with or otherwise encompassing the sensors 138*a-c*.

In some embodiments, the sensor components 216 may be arranged about the circumference of the wellbore dart 200, such as being positioned on one or more of the collet fingers 204. As best seen in FIG. 2B, the sensor components 216 may seated or otherwise secured within corresponding recesses 218 (FIG. 2B) defined in the collet fingers 204. In other embodiments, however, the sensor components 216 may be secured to the outer radial surface of the collet fingers 204. In yet other embodiments, the sensor components 216 may be positioned on the body 202 at or near the downhole end 212 or positioned on a combination of the body 202 and the collet fingers 204. In even further embodiments, the wellbore dart 200 itself may be or otherwise encompass the sensor component 216. In other words, in some embodiments, the wellbore dart 200 itself may be made of a material (i.e., magnets) or otherwise comprise an mechanism, device (i.e., RFID tag), element, or substance that is able to interact with the sensors 138*a-c* of the sliding sleeve assemblies 130*a-c* of FIG. 1 and thereby confirm that the wellbore dart 200 has come into proximity of the given sensor 138*a-c*.

Figure 3A:
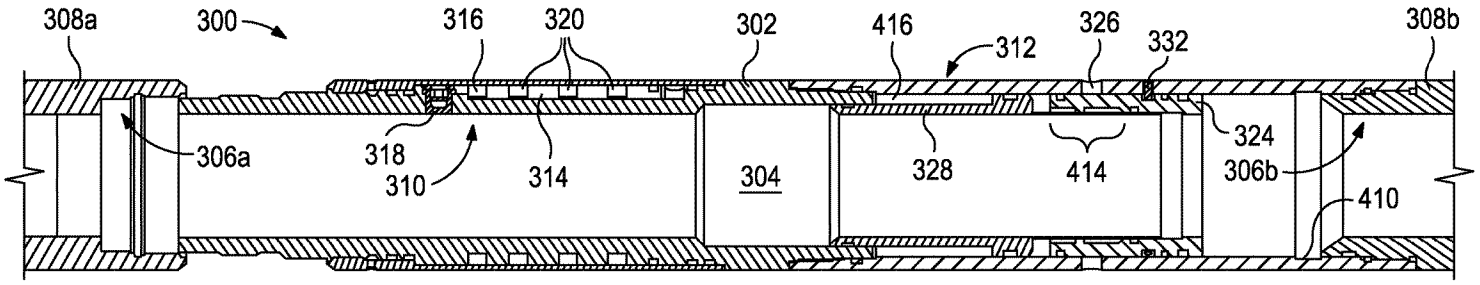
FIGS. 3A and 3B illustrate cross-sectional side views of an exemplary sliding sleeve assembly, according to one or more embodiments.
Figure 3B:
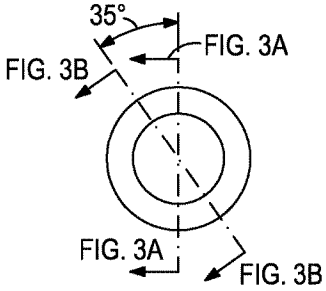
Figure 3B:
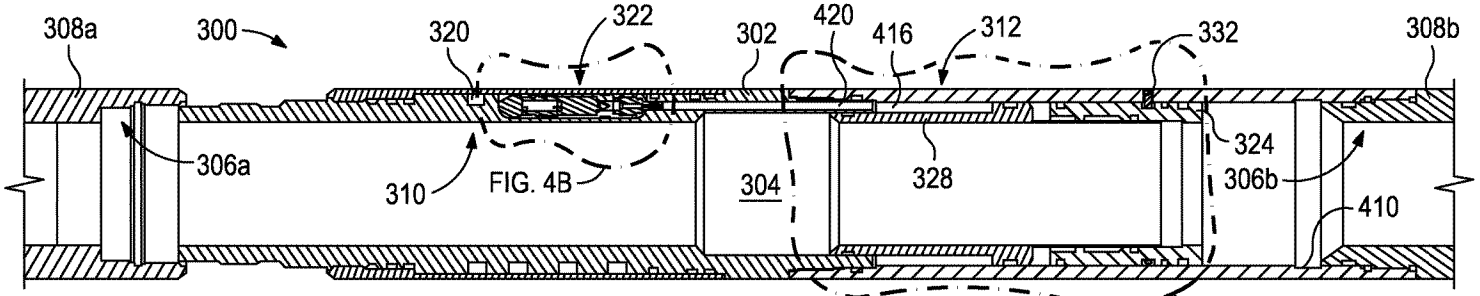

Referring now to FIGS. 3A and 3B, illustrated are cross-sectional side views of an exemplary sliding sleeve assembly 300, according to one or more embodiments. With reference to the cross-sectional angular indicator provided at the center of the page, FIG. 3A provides a cross-sectional side view of the sliding sleeve assembly 300 (hereafter "the assembly 300") along a vertical line, and FIG. 3B provides a cross-sectional view of the assembly 300 along a line offset from vertical by 35°. The assembly 300 may be similar in some respects to any of the sliding sleeve assemblies 130*a-c* of FIG. 1. As illustrated, the assembly 300 may include an elongate completion body 302 that defines an inner flow passageway 304. The completion body 302 may have a first end 306*a* coupled to an upper sub 308*a* and a second end 306*b* coupled to a lower sub 308*b*. The assembly 300 may form part of a downhole completion, such as the completion assembly 120 of FIG. 1. Accordingly, the upper and lower subs 308*a,b* may be used to couple the completion body 302 to corresponding upper and lower portions of the completion assembly 120 and/or the work string 114 (FIG. 1).

In some embodiments, the completion body 302 may include an electronics sub 310 and a ported sub 312. The electronics sub 310 may be threaded or otherwise mechanically fastened to the ported sub 312 so that the completion body 302 forms a continuous, elongate, and cylindrical structure. In other embodiments, the electronics sub 310 and the ported sub 312 may be integrally formed as a monolithic structure, without departing from the scope of the disclosure.

As best seen in FIG. 3A, the electronics sub 310 may define or otherwise provide an electronics cavity 314 that houses electronic circuitry 316, one or more sensors 318, and one or more batteries 320 (three shown). As best seen in FIG. 3B, the electronics sub 310 may further provide an actuator 322 (FIG. 3B). The batteries 320 may provide power to operate the electronic circuitry 316, the sensor(s) 318, and the actuator 322. The sensor(s) 318 may be similar to the sensors 138*a-c* of FIG. 1, and therefore may be capable of detecting a wellbore dart (not shown) that traverses the assembly 300 via the inner flow passageway 304.

The ported sub 312 may include a sliding sleeve 324, one or more ports 326 (FIG. 3A), and an actuation sleeve 328. The sliding sleeve 324 may be similar to the sliding sleeves 132 of FIG. 1 and may be movably arranged within the ported sub 312. The ports 326 may be similar to the ports 134 of FIG. 1 and may be defined through the ported sub 312 to enable fluid communication between the inner flow passageway 304 and an exterior of the ported sub 312, such as a surrounding subterranean formation (e.g., the formation 108 of FIG. 1). In FIGS. 3A and 3B, the sliding sleeve 324 is depicted in a closed position, where the sliding sleeve 324 generally occludes the ports 326 and thereby prevents fluid communication therethrough. As described below, however, the sliding sleeve 324 can be moved axially within the ported sub 312 to an open position, where the ports 326 are exposed and thereby facilitate fluid communication therethrough.

Figure 4A:
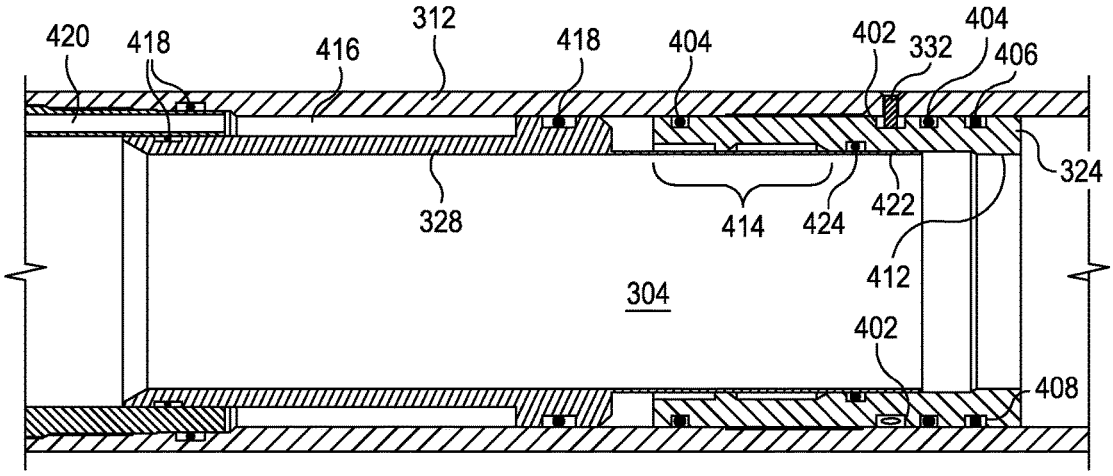
FIG. 4A is an enlarged view of the sliding sleeve and the actuation sleeve of FIGS. 3A and 3B, as indicated by the labeled dashed line provided in FIG. 3B, according to one or more embodiments.

Referring to FIG. 4A, illustrated is an enlarged view of the sliding sleeve 324 and the actuation sleeve 328, as indicated by the labeled dashed line provided in FIG. 3B. In some embodiments, the sliding sleeve 324 may be secured in the closed position with one or more shearable devices 332 (one shown). In the illustrated embodiment, the shearable devices 332 may include one or more shear pins that extend from the ported sub 312 (i.e., the completion body 302) and into corresponding blind bores 402 defined on the outer surface of the sliding sleeve 324. In other embodiments, the shearable device(s) 332 may be a shear ring or any other device or mechanism configured to shear or otherwise fail upon assuming a predetermined shear load applied to the sliding sleeve 324.

The sliding sleeve 324 may further include one or more dynamic seals 404 (two shown) arranged between the outer surface of the sliding sleeve 324 and the inner surface of the ported sub 312. The dynamic seals 404 may be configured to provide fluid isolation between the sliding sleeve 324 and the ported sub 312 and thereby prevent fluid migration through the ports 326 (FIG. 3A) and into the inner flow passageway 304 when the sliding sleeve 324 is in the closed position. The dynamic seals 404 may be similar to the dynamic seal 210 of FIGS. 2A-2B, and therefore will not be described again. In at least one embodiment, as illustrated, one or both of the dynamic seals 404*a,b* may be an O-ring.

In some embodiments, the sliding sleeve 324 may further include a lock ring 406 disposed or positioned within a lock ring groove 408 defined in the sliding sleeve 324. The lock ring 406 may be an expandable C-ring, for example, that expands upon locating a lock ring mating groove 410 (FIGS. 3A-3B). Accordingly, as the sliding sleeve 324 moves to its open position, as described below, the lock ring 406 may locate and expand into the lock ring mating groove 410, and thereby prevent the sliding sleeve 324 from moving back to the closed position.

The sliding sleeve 324 may further provide a seal bore 412 and a sleeve mating profile 414 defined on the inner radial surface of the sliding sleeve 324. As illustrated, the seal bore 412 may be arranged downhole from the sleeve mating profile 414, but may equally be arranged on either end (or at an intermediate location) of the sliding sleeve 324, without departing from the scope of the disclosure. As described below, the dart profile 208 of the wellbore dart 200 of FIGS. 2A and 2B may be configured to match or otherwise correspond to the sleeve mating profile 414 of the sliding sleeve 324.

Figure 5A:
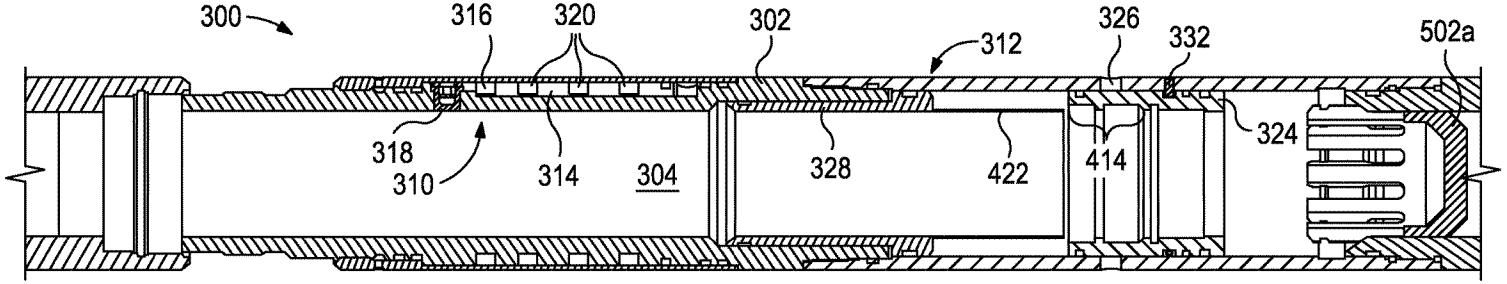
FIGS. 5A-5C illustrate progressive cross-sectional side views of the assembly of FIGS. 3A and 3B, according to one or more embodiments.
Figure 5B:
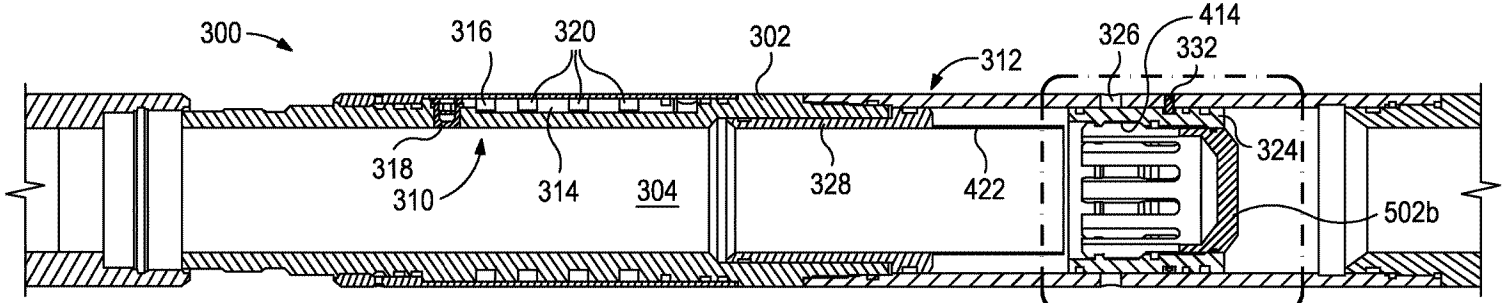
Figure 5C:
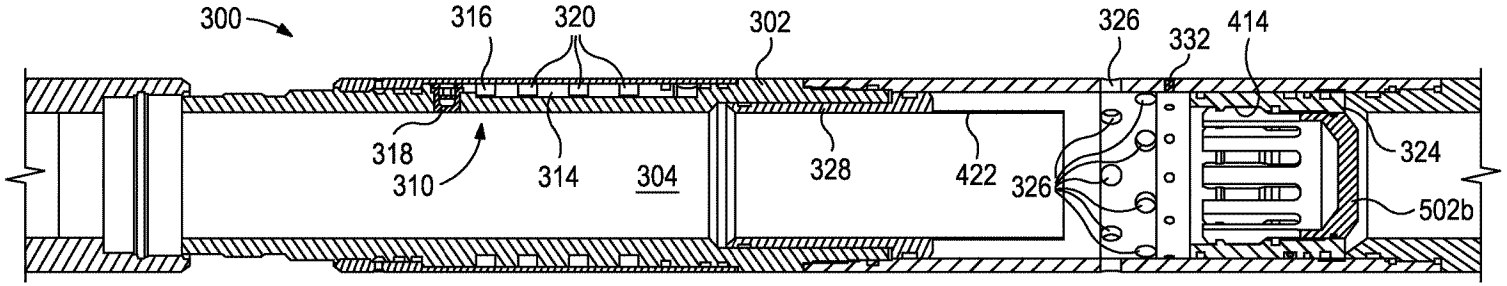

The actuation sleeve 328 may also be movably arranged within the ported sub 312 between a run-in configuration, as shown in FIGS. 3A-3B and FIG. 4A, and an actuated configuration, as shown in FIGS. 5A-5C. In some embodiments, a hydraulic cavity 416 may be defined between the actuation sleeve 328 and the ported sub 312 (e.g., the completion body 302) and sealed at each end with appropriate sealing devices 418, such as O-rings or the like. In such embodiments, the hydraulic cavity 416 may be fluidly coupled to the electronics cavity 314 (FIG. 3A) via one or more hydraulic conduits 420. The hydraulic cavity 416 may be filled with a hydraulic fluid, such as silicone oil, and maintained at an increased pressure with respect to the electronics cavity 314, which may be at ambient pressure.

The actuation sleeve 328 may have or otherwise provide an axial extension 422 that extends within at least a portion of the sliding sleeve 324. When the actuation sleeve 328 is in its run-in configuration, as shown in FIG. 4A, the axial extension 422 may be configured to cover or otherwise occlude the sleeve mating profile 414. As a result, any wellbore darts passing through the inner flow passageway 304 may be unable to mate with the sleeve mating profile 414. A wiper ring 424, such as an O-ring or the like, may be arranged between the axial extension 422 and the inner radial surface of the sliding sleeve 324 to protect the sleeve mating profile 414 by preventing debris and sand from entering the sleeve mating profile 414.

Figure 4B:
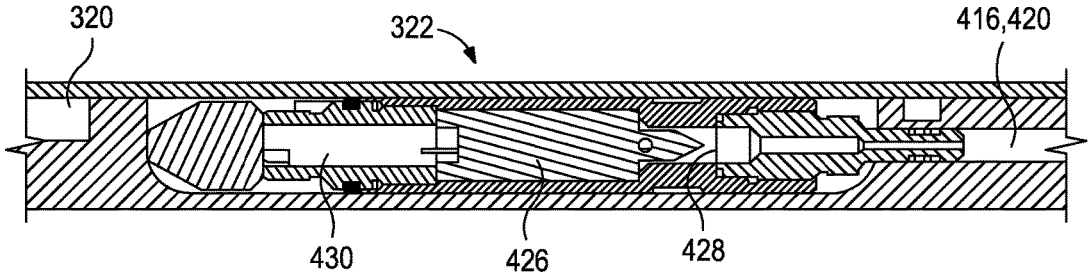
FIG. 4B is an enlarged view of an exemplary actuation device, as indicated by the labeled dashed line provided in FIG. 3B, according to one or more embodiments.

Referring to FIG. 4B, illustrated is an enlarged view of the actuator 322, as indicated by the labeled dashed line provided in FIG. 3B. The actuator 322 may be any mechanical, electro-mechanical, hydraulic, or pneumatic actuation device capable of manipulating the configuration or position of the actuation sleeve 328. Accordingly, the actuator 322 may be any device that can be used or otherwise triggered to move the actuation sleeve 328 from its run-in configuration (FIGS. 3A-3B and FIG. 4A) to its actuated configuration (FIGS. 5A-5C). In the illustrated embodiment, the actuator 322 is an electro-hydraulic piston lock that includes a thruster 426 and a frangible member 428. The frangible member 428 may be, for example, a burst disk or pressure barrier that prevents the pressurized hydraulic fluid within the hydraulic cavity 416 from escaping into the electronics cavity 314 (FIG. 3A) via the hydraulic conduit 420 (FIGS. 3B and 4A). Accordingly, a pressure differential between the electronics and hydraulic cavities 314, 416 is maintained across the frangible member 428 while intact.

The thruster 426 may be communicably coupled to the electronic circuitry 316 (FIG. 3A), which, as described above, is communicably coupled to the sensor(s) 318. When the sensor(s) 318 positively detects a wellbore dart, or a predetermined number of wellbore darts, the electronic circuitry 316 may send an actuation signal to the actuator 322. The actuator 322 may include a chemical charge 430 that is fired upon receiving the actuation signal, and firing the chemical charge 430 may force the thruster 426 into the frangible member 428 to rupture or penetrate the frangible member 428. Upon rupturing the frangible member 428, the pressurized hydraulic fluid within the hydraulic cavity 416 is able to escape into the electronics cavity 314 via the hydraulic conduit 420 in seeking pressure equilibrium.

Referring again to FIG. 3B, as the pressurized hydraulic fluid within the hydraulic cavity 416 seeks pressure equilibrium by rushing into the electronics cavity 314, a pressure differential is generated across the actuation sleeve 328. This generated pressure differential may result in the actuation sleeve 328 moving to its actuated configuration in the uphole direction (i.e., to the left in FIG. 3B), as shown in FIGS. 5A-5C. Moving the actuation sleeve 328 to the actuated configuration may uncover the sleeve mating profile 414 (FIG. 4A).

Referring again to FIG. 3A and additionally to FIGS. 5A-5C, exemplary operation of the assembly 300 is now provided. More particularly, FIGS. 3A and 5A-5C depict progressive cross-sectional views of the assembly 300 during actuation of the sliding sleeve 324 as it moves between its closed and open positions. It will be appreciated that operation of the assembly 300 may be equally descriptive of operation of any of the sliding sleeve assemblies 130*a-c* of FIG. 1. In FIG. 3A, the assembly 300 is depicted in a "run-in" or closed configuration, where the sliding sleeve 324 generally occludes the ports 326 defined in the completion body 302 of the assembly 300.

In FIG. 5A, a first wellbore dart 502*a* is depicted as having been introduced into the work string 114 (FIG. 1) and conveyed to and through the assembly 300. The first wellbore dart 502*a* may be similar to the wellbore dart 200 of FIGS. 2A-2B, and therefore will not be described again. As illustrated, the first wellbore dart 502*a* has passed through the inner flow passageway 304 downhole from the sensor 318 and is proceeding in a downhole direction (e.g., to the right in FIG. 5A). In some embodiments, the first wellbore dart 502*a* may be pumped to the assembly 300 from the surface 104 (FIG. 1) using hydraulic pressure. In other embodiments, the first wellbore dart 502*a* may be dropped through the work string 114 (FIG. 1) from the surface 104 until locating the assembly 300. In yet other embodiments, the first wellbore dart 502*a* may be conveyed through the work string 114 by wireline, slickline, coiled tubing, etc., or it may be self-propelled until locating the assembly 300. In even further embodiments, any combination of the foregoing techniques may be employed to convey to the first wellbore dart 502*a* to the assembly 300.

As the first wellbore dart 502*a* passes by the sensor 318, or comes into close proximity therewith, the sensor 318 may detect its presence and send a detection signal to the electronic circuitry 316 indicating the same. The electronic circuitry 316, in turn, may register a "count" of the first wellbore dart 502*a* and a total running count of how many wellbore darts (including the first wellbore dart 502*a*) have bypassed the assembly 300. When a predetermined number of wellbore darts (including the first wellbore dart 502*a*) have been counted, the electronic circuitry 316 may be programmed to actuate the assembly 300. More particularly, when the predetermined number of wellbore darts has been detected and otherwise registered, the electronic circuitry 316 may send an actuation signal to the actuator 322 (FIGS. 3B and 4B), which operates to move the actuation sleeve 328 from the run-in configuration, as shown in FIG. 3A, to the actuated configuration, as shown in FIGS. 5A-5C.

In some embodiments, as mentioned above, the actuator 322 may be any mechanical, electro-mechanical, hydraulic, or pneumatic actuation device capable of displacing the actuation sleeve 328 from the run-in configuration to the actuated configuration. In other embodiments, however, as described above with reference to FIG. 4B, the actuator 322 may be an electro-hydraulic piston lock that includes the thruster 426 and the frangible member 428 that provides a pressure barrier between the electronics cavity 314 and the hydraulic cavity 416. Upon receiving the actuation signal, the thruster 426 penetrates the frangible member 428 and the pressurized hydraulic fluid within the hydraulic cavity 416 escapes into the electronics cavity 314 via the hydraulic conduit 420 as it seeks pressure equilibrium. As the hydraulic fluid escapes the hydraulic cavity 416, a pressure differential is generated across the actuation sleeve 328 that urges the actuation sleeve 328 to move to the actuation configuration.

Referring to FIG. 5A, as the actuation sleeve 328 moves to its actuation configuration, the sleeve mating profile 414 gradually becomes exposed to the inner flow passageway 304 as the axial extension 422 of the actuation sleeve 328 moves in the uphole direction. With the sleeve mating profile 414 exposed, any subsequent wellbore dart that is introduced into the inner flow passageway 304 may be able to mate with the sleeve mating profile 414.

FIG. 5B shows a second wellbore dart 502*b* as having been introduced into the work string 114 (FIG. 1) and conveyed to the assembly 300. Similar to the first wellbore dart 502*a* (FIG. 5A), the second wellbore dart 502*b* may be similar to the wellbore dart 200 of FIGS. 2A-2B and therefore will not be described again. Moreover, the first and second wellbore darts 502*a,b* may exhibit the same dart profile (e.g., the dart profile 208 of FIGS. 2A-2B). Upon locating the assembly 300, the second wellbore dart 502*b* may be configured to mate with the sliding sleeve 324.

Figure 6:
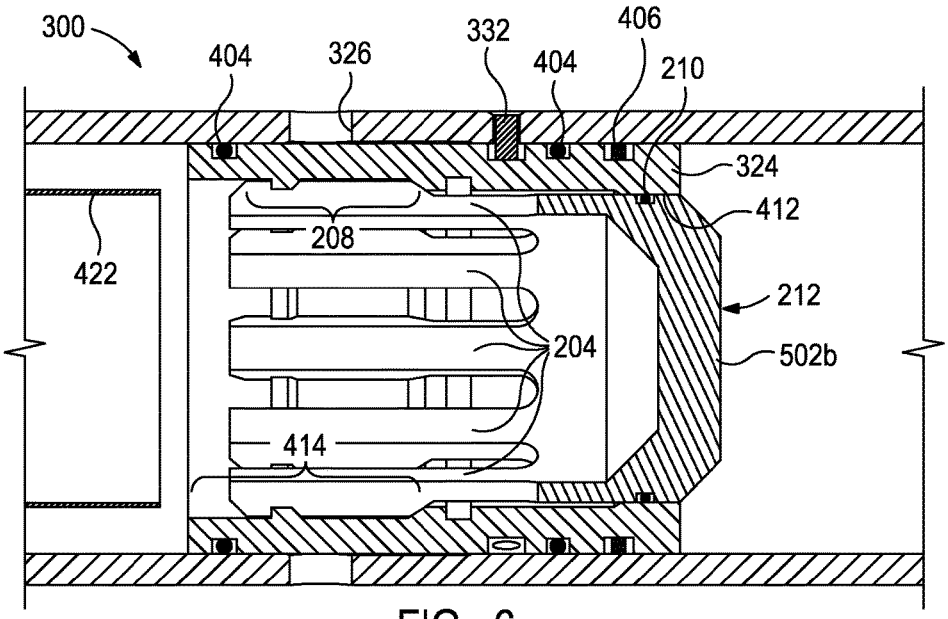
FIG. 6 is an enlarged view of a wellbore dart mating with a sliding sleeve, as indicated by the dashed area of FIG. 5B, according to one or more embodiments.

Referring briefly to FIG. 6, illustrated is an enlarged view of the second wellbore dart 502*b* as it mates with the sliding sleeve 324, as indicated in the dashed area of FIG. 5B, according to one or more embodiments. Upon locating the assembly 300, the downhole end 212 of the second wellbore dart 502*b* may be configured to enter the seal bore 412 provided on the inner radial surface of the sliding sleeve 324. The dynamic seal 210 of the second wellbore dart 502*b* may be configured to engage and seal against the seal bore 412, thereby allowing fluid pressure behind the second wellbore dart 502*b* to increase.

The dart profile 208 of the second wellbore dart 502*b* may be configured to match or otherwise correspond to the sleeve mating profile 414 of the sliding sleeve 324. Accordingly, upon locating the assembly 300, the dart profile 208 may mate with and otherwise engage the sleeve mating profile 414, thereby effectively stopping the downhole progression of the second wellbore dart 502*b*. Once the dart profile 208 axially and radially aligns with the sleeve mating profile 414, the collet fingers 204 of the second wellbore dart 502*b* may be configured to spring radially outward and thereby mate the second wellbore dart 502*b* to the sliding sleeve 324.

Referring again to FIGS. 5A-5C and, more particularly, to FIG. 5C, with the dart profile 208 successfully mated with the sleeve mating profile 414, an operator may increase the fluid pressure within the work string 114 (FIG. 1) and the inner flow passageway 304 uphole from the second wellbore dart 502*b* to move the sliding sleeve 324 to the open position. The dynamic seal 210 (FIG. 6) of the second wellbore dart 502*b* may be configured to substantially prevent the migration of high-pressure fluids past the second wellbore dart 502*b* in the downhole direction. As a result, fluid pressure uphole from the second wellbore dart 502*b* may be increased. Moreover, the one or more shearable devices 332 may be configured to maintain the sliding sleeve 324 in the closed position until assuming a predetermined shear load. As the fluid pressure increases within the inner flow passageway 304, the increased pressure acts on the second wellbore dart 502*b*, which, in turn, acts on the sliding sleeve 324 via the mating engagement between the dart profile 208 and the sleeve mating profile 414. Accordingly, increasing the fluid pressure within the work string 114 (FIG. 1) may serve to increase the shear load assumed by the shearable devices 332 holding the sliding sleeve 324 in the closed position.

The fluid pressure may increase until reaching a predetermined pressure threshold, which results in the predetermined shear load being assumed by the shearable devices 332 and their subsequent failure. Once the shearable devices 332 fail, the sliding sleeve 324 may be free to axially translate within the ported sub 312 to the open position, as shown in FIG. 5C. With the sliding sleeve 324 in the open position, the ports 326 are exposed and a well operator may then be able to perform one or more wellbore operations, such as stimulating a surrounding formation (e.g., the formation 108 of FIG. 1).

Following stimulation operations, in at least one embodiment, a drill bit or mill (not shown) may be introduced downhole to drill out the second wellbore dart 502*b*, thereby facilitating fluid communication past the assembly 300. While important, those skilled in the art will readily recognize that this process requires valuable time and resources. According to the present disclosure, however, the wellbore darts may be made at least partially of a dissolvable and/or degradable material to obviate the time-consuming requirement of drilling out wellbore darts in order to facilitate fluid communication therethrough. As used herein, the term "degradable material" refers to any material or substance that is capable of or otherwise configured to degrade or dissolve following the passage of a predetermined amount of time or after interaction with a particular downhole environment (e.g., temperature, pressure, downhole fluid, etc.), treatment fluid, etc.

Referring again to FIG. 2B, for example, in some embodiments, the entire wellbore dart 200 may be made of a degradable material. In other embodiments, only a portion of the wellbore dart 200 may be made of the degradable material. For instance, in some embodiments, all or a portion of the downhole end 212 of the body 202 may be made of the degradable material. As illustrated, for example, the body 202 may further include a tip 220 that forms an integral part of the body 202 or is otherwise coupled thereto. In the illustrated embodiment, the tip 220 may be threadably coupled to the body 202. In other embodiments, however, the tip 220 may alternatively be welded, brazed, adhered, or mechanically fastened to the body 202, without departing from the scope of the disclosure. After stimulation operations have completed, the degradable material may be configured to dissolve or degrade, thereby leaving a full-bore inner diameter through the sliding sleeve assemblies 130*a-c* (FIG. 1) without the need to mill or drill out.

Suitable degradable materials that may be used in accordance with the embodiments of the present disclosure include borate glasses, polyglycolic acid and polylactic acid. Polyglycolic acid and polylactic acid tend to degrade by hydrolysis as the temperature increases. Other suitable degradable materials include oil-degradable polymers, which may be either natural or synthetic polymers and include, but are not limited to, polyacrylics, polyamides, and polyolefins such as polyethylene, polypropylene, polyisobutylene, and polystyrene. Other suitable oil-degradable polymers include those that have a melting point that is such that it will dissolve at the temperature of the subterranean formation in which it is placed.

In addition to oil-degradable polymers, other degradable materials that may be used in conjunction with the embodiments of the present disclosure include, but are not limited to, degradable polymers, dehydrated salts, and/or mixtures of the two. As for degradable polymers, a polymer is considered to be "degradable" if the degradation is due to, in situ, a chemical and/or radical process such as hydrolysis, oxidation, or UV radiation. Suitable examples of degradable polymers that may be used in accordance with the embodiments of the present invention include polysaccharides such as dextran or cellulose; chitins; chitosans; proteins; aliphatic polyesters; poly(lactides); poly(glycolides); poly(ε-caprolactones); poly(hydroxybutyrates); poly(anhydrides); aliphatic or aromatic polycarbonates; poly(orthoesters); poly (amino acids); poly(ethylene oxides); and polyphosphazenes. Of these suitable polymers, as mentioned above, polyglycolic acid and polylactic acid may be preferred.

Polyanhydrides are another type of particularly suitable degradable polymer useful in the embodiments of the present invention. Polyanhydride hydrolysis proceeds, in situ, via free carboxylic acid chain-ends to yield carboxylic acids as final degradation products. The erosion time can be varied over a broad range of changes in the polymer backbone. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

Blends of certain degradable materials may also be suitable. One example of a suitable blend of materials is a mixture of polylactic acid and sodium borate where the mixing of an acid and base could result in a neutral solution where this is desirable. Another example would include a blend of poly(lactic acid) and boric oxide. The choice of degradable material also can depend, at least in part, on the conditions of the well, e.g., wellbore temperature. For instance, lactides have been found to be suitable for lower temperature wells, including those within the range of 60° F. to 150° F., and polylactides have been found to be suitable for well bore temperatures above this range. Also, poly (lactic acid) may be suitable for higher temperature wells. Some stereoisomers of poly(lactide) or mixtures of such stereoisomers may be suitable for even higher temperature applications. Dehydrated salts may also be suitable for higher temperature wells.

In other embodiments, the degradable material may be a galvanically corrodible metal or material configured to degrade via an electrochemical process in which the galvanically corrodible metal corrodes in the presence of an electrolyte (e.g., brine or other salt fluids in a wellbore). Suitable galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium.

Embodiments disclosed herein include:

A. A sliding sleeve assembly that includes a completion body that defines an inner flow passageway and one or more ports that enable fluid communication between the inner flow passageway and an exterior of the completion body, a sliding sleeve arranged within the completion body and having a sleeve mating profile defined on an inner surface of the sliding sleeve, the sliding sleeve being movable between a closed position, where the sliding sleeve occludes the one or more ports, and an open position, where the sliding sleeve is moved to expose the one or more ports, a plurality of wellbore darts each having a body and a dart profile defined on an outer surface of the body, the dart profile of each wellbore dart being matable with the sleeve mating profile, one or more sensors positioned on the completion body to detect the plurality of wellbore darts as traversing the inner flow passageway, and an actuation sleeve arranged within the completion body and movable between a run-in configuration, where the actuation sleeve occludes the sleeve mating profile, and an actuated configuration, where the actuation sleeve is moved to expose the sleeve mating profile.

B. A method that includes introducing one or more wellbore darts into a work string extended within a wellbore, the work string providing a sliding sleeve assembly that includes a completion body defining an inner flow passageway and one or more ports that enable fluid communication between the inner flow passageway and an exterior of the completion body, wherein the sliding sleeve assembly further includes a sliding sleeve arranged within the completion body and defining a sleeve mating profile on an inner surface of the sliding sleeve, detecting the one or more wellbore darts with one or more sensors positioned on the completion body, the one or more wellbore darts each having a body and a dart profile defined on an outer surface of the body, moving an actuation sleeve arranged within the completion body from a run-in configuration to an actuated configuration when the one or more sensors detects a predetermined number of the one or more wellbore darts, exposing the sleeve mating profile as the actuation sleeve moves to the actuated configuration, locating one of the one or more wellbore darts on the sliding sleeve as the dart profile of the one of the one or more wellbore darts mates with the sleeve mating profile, increasing a fluid pressure within the work string uphole from the one of the one or more wellbore darts, and moving the sliding sleeve from a closed position, where the sliding sleeve occludes the one or more ports, to an open position, where the one or more ports are exposed.

Each of embodiments A and B may have one or more of the following additional elements in any combination: Element 1: further comprising electronic circuitry communicably coupled to the one or more sensors, and an actuator communicably coupled to the electronic circuitry, wherein, when the one or more sensors detect a predetermined number of the plurality of wellbore darts, the electronic circuitry sends an actuation signal to the actuator to move the actuation sleeve to the actuated configuration. Element 2: wherein the actuator is selected from the group consisting of a mechanical actuator, an electro-mechanical actuator, a hydraulic actuator, a pneumatic actuator, and any combination thereof. Element 3: wherein the actuator is an electro-hydraulic piston lock. Element 4: wherein each wellbore dart exhibits a known magnetic property detectable by the one or more sensors. Element 5: wherein each wellbore dart emits a radio frequency detectable by the one or more sensors. Element 6: wherein the one or more sensors are mechanical switches that are mechanically manipulated through physical contact with the plurality of wellbore darts as each wellbore dart traverses the inner flow passageway. Element 7: wherein at least a portion of the body of each wellbore dart is made from a material selected from the group consisting of iron, an iron alloy, steel, a steel alloy, aluminum, an aluminum alloy, copper, a copper alloy, plastic, a composite material, a degradable material, and any combination thereof. Element 8: wherein the degradable material is a material selected from the group consisting of a borate glass, a galvanically-corrodible metal, polyglycolic acid, polylactic acid, and any combination thereof. Element 9: wherein the actuation sleeve includes an axial extension that extends within at least a portion of the sliding sleeve to occlude the sleeve mating profile.

Element 10: wherein the sliding sleeve assembly further includes electronic circuitry communicably coupled to the one or more sensors, and wherein detecting the one or more wellbore darts with the one or more sensors comprises sending a detection signal to the electronic circuitry with the one or more sensors upon detecting each wellbore dart, and counting with the electronic circuitry how many wellbore darts have been detected by the one or more sensors based on each detection signal received. Element 11: wherein the sliding sleeve assembly further includes an actuator communicably coupled to the electronic circuitry, and wherein moving the actuation sleeve further comprises sending an actuation signal to the actuator with the electronic circuitry when the one or more sensors detects the predetermined number of the one or more wellbore darts, and actuating the actuation sleeve with the actuator to the actuated configuration upon receiving the actuation signal. Element 12: wherein detecting the one or more wellbore darts with the one or more sensors comprises detecting a known magnetic property exhibited by the one or more wellbore darts. Element 13: wherein detecting the one or more wellbore darts with the one or more sensors comprises detecting a radio frequency emitted by the one or more wellbore darts. Element 14: wherein the one or more sensors are mechanical switches, and wherein detecting the one or more wellbore darts with the one or more sensors comprises physically contacting the one or more sensors with the one or more wellbore darts as the one or more wellbore darts traverse the inner flow passageway. Element 15: wherein increasing the fluid pressure within the work string uphole from the subsequent one of the one or more wellbore darts further comprises generating a pressure differential across the one of the one or more wellbore darts and thereby transferring an axial load to the sliding sleeve and one or more shearable devices securing the sliding sleeve in the closed position, and assuming a predetermined axial load with the one or more shearable devices such that the one or more shearable devices fail and thereby allow the sliding sleeve to move to the open position. Element 16: further comprising introducing a treatment fluid into the work string, injecting the treatment fluid into a surrounding subterranean formation via the one or more ports, and releasing the fluid pressure within the work string. Element 17: wherein at least a portion of the one or more wellbore darts is made of a degradable material selected from the group consisting of a borate glass, a galvanically-corrodible metal, polyglycolic acid, polylactic acid, and any combination thereof, the method further comprising allowing the degradable material to degrade. Element 18: further comprising introducing a drill bit into the work string and advancing the drill bit to the one of the one or more wellbore darts, and drilling out the one of the one or more wellbore darts with the drill bit.

By way of example, Embodiment A may be used with Elements 1, 2, and 3; with Elements 1, 7, and 8; with Elements 1, 7, 8, and 10; with Elements 1, 4, and 5, etc.

By way of further example, Embodiment B may be used with Elements 12 and 13; with Elements 12, 13, and 14; with Elements 15 and 16; with Elements 16, 17, and 18, etc.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A sliding sleeve assembly, comprising:

a completion body that defines an inner flow passageway and one or more ports that enable fluid communication between the inner flow passageway and an exterior of the completion body;

a sliding sleeve arranged within the completion body and having a sleeve mating profile defined on an inner surface of the sliding sleeve, the sliding sleeve being movable between a closed position, where the sliding sleeve occludes the one or more ports, and an open position, where the sliding sleeve is moved to expose the one or more ports;

a plurality of wellbore darts each having a body with a plurality of collet fingers and a dart profile defined on an outer surface of the body, the dart profile of each wellbore dart being mateable with the sleeve mating profile, wherein a plurality of sensor components are positioned on the plurality of the collet fingers of each wellbore dart;

one or more sensors positioned on the completion body uphole to the sliding sleeve to detect the plurality of sensor components of each of the plurality of wellbore darts as traversing the inner flow passageway prior to traversing the sliding sleeve; and an actuation sleeve arranged within the completion body and movable between a run-in configuration, where the actuation sleeve occludes the sleeve mating profile, and an actuated configuration, where the actuation sleeve is moved in the uphole direction to expose the sleeve mating profile.

2. The sliding sleeve assembly of claim 1, further comprising:

electronic circuitry communicably coupled to the one or more sensors; and an actuator communicably coupled to the electronic circuitry, wherein, when the one or more sensors detect a predetermined number of the plurality of wellbore darts, the electronic circuitry sends an actuation signal to the actuator to move the actuation sleeve to the actuated configuration.

3. The sliding sleeve assembly of claim 2, wherein the actuator is selected from the group consisting of a mechanical actuator, an electro-mechanical actuator, a hydraulic actuator, a pneumatic actuator, and any combination thereof.

4. The sliding sleeve assembly of claim 2, wherein the actuator is an electro-hydraulic piston lock.

5. The sliding sleeve assembly of claim 1, wherein each wellbore dart exhibits a known magnetic property detectable by the one or more sensors.

6. The sliding sleeve assembly of claim 1, wherein each wellbore dart emits a radio frequency detectable by the one or more sensors.

7. The sliding sleeve assembly of claim 1, wherein the one or more sensors are mechanical switches that are mechanically manipulated through physical contact with the plurality of wellbore darts as each wellbore dart traverses the inner flow passageway.

8. The sliding sleeve assembly of claim 1, wherein at least a portion of the body of each wellbore dart is made from a material selected from the group consisting of iron, an iron alloy, steel, a steel alloy, aluminum, an aluminum alloy, copper, a copper alloy, plastic, a composite material, a degradable material, and any combination thereof.

9. The sliding sleeve assembly of claim 8, wherein the degradable material is a material selected from the group consisting of a borate glass, a galvanically-corrodible metal, polyglycolic acid, polylactic acid, and any combination thereof.

10. The sliding sleeve assembly of claim 1, wherein the actuation sleeve includes an axial extension that extends within at least a portion of the sliding sleeve to occlude the sleeve mating profile.

11. A method, comprising:

introducing one or more wellbore darts into a work string extended within a wellbore, the work string providing a sliding sleeve assembly that includes a completion body defining an inner flow passageway and one or more ports that enable fluid communication between the inner flow passageway and an exterior of the completion body, wherein the sliding sleeve assembly further includes a sliding sleeve arranged within the completion body and defining a sleeve mating profile on an inner surface of the sliding sleeve, and each of the wellbore darts has a body with a plurality of collet fingers and a plurality of sensor components positioned on the plurality of the collet fingers;

detecting the one or more wellbore darts via the plurality of sensor components prior to traversing the sliding sleeve with one or more sensors positioned on the completion body uphole to the sliding sleeve, the one or more wellbore darts each having a body and a dart profile defined on an outer surface of the body;

moving an actuation sleeve arranged within the completion body from a run-in configuration to an actuated configuration when the one or more sensors detects a predetermined number of the one or more wellbore darts;

exposing the sleeve mating profile as the actuation sleeve moves in the uphole direction to the actuated configuration;

locating one of the one or more wellbore darts on the sliding sleeve as the dart profile of the one of the one or more wellbore darts mates with the sleeve mating profile;

increasing a fluid pressure within the work string uphole from the one of the one or more wellbore darts; and moving the sliding sleeve from a closed position, where the sliding sleeve occludes the one or more ports, to an open position, where the one or more ports are exposed.

12. The method of claim 11, wherein the sliding sleeve assembly further includes electronic circuitry communicably coupled to the one or more sensors, and wherein detecting the one or more wellbore darts with the one or more sensors comprises:

sending a detection signal to the electronic circuitry with the one or more sensors upon detecting each wellbore dart; and counting with the electronic circuitry how many wellbore darts have been detected by the one or more sensors based on each detection signal received.

13. The method of claim 12, wherein the sliding sleeve assembly further includes an actuator communicably coupled to the electronic circuitry, and wherein moving the actuation sleeve further comprises:

sending an actuation signal to the actuator with the electronic circuitry when the one or more sensors detects the predetermined number of the one or more wellbore darts; and actuating the actuation sleeve with the actuator to the actuated configuration upon receiving the actuation signal.

14. The method of claim 11, wherein detecting the one or more wellbore darts with the one or more sensors comprises detecting a known magnetic property exhibited by the one or more wellbore darts.

15. The method of claim 11, wherein detecting the one or more wellbore darts with the one or more sensors comprises detecting a radio frequency emitted by the one or more wellbore darts.

16. The method of claim 11, wherein the one or more sensors are mechanical switches, and wherein detecting the one or more wellbore darts with the one or more sensors comprises physically contacting the one or more sensors with the one or more wellbore darts as the one or more wellbore darts traverse the inner flow passageway.

17. The method of claim 11, wherein increasing the fluid pressure within the work string uphole from the subsequent one of the one or more wellbore darts further comprises:

generating a pressure differential across the one of the one or more wellbore darts and thereby transferring an axial load to the sliding sleeve and one or more shearable devices securing the sliding sleeve in the closed position; and assuming a predetermined axial load with the one or more shearable devices such that the one or more shearable devices fail and thereby allow the sliding sleeve to move to the open position.

18. The method of claim 11, further comprising:

introducing a treatment fluid into the work string;

injecting the treatment fluid into a surrounding subterranean formation via the one or more ports; and releasing the fluid pressure within the work string.

19. The method of claim 18, wherein at least a portion of the one or more wellbore darts is made of a degradable material selected from the group consisting of a borate glass, a galvanically-corrodible metal, polyglycolic acid, polylactic acid, and any combination thereof, the method further comprising allowing the degradable material to degrade.

20. The method of claim 18, further comprising:

introducing a drill bit into the work string and advancing the drill bit to the one of the one or more wellbore darts; and drilling out the one of the one or more wellbore darts with the drill bit.

* * * * *